United States Patent [19]

Staples

[11] Patent Number: 5,023,413

[45] Date of Patent: Jun. 11, 1991

[54] PLUNGER SWITCH

[75] Inventor: Paul R. Staples, Cub Run, Ky.

[73] Assignee: E. M. B. Corporation, Elizabethtown, Ky.

[21] Appl. No.: 522,687

[22] Filed: May 14, 1990

[51] Int. Cl.[5] ..... H01H 3/16

[52] U.S. Cl. ..... 200/61.76; 200/295

[58] Field of Search ..... 200/61.76, 61.77, 61.78, 200/61.79, 61.8, 61.81, 61.82, 294, 295, 302.1, 302.2, 16 A, 243

[56] References Cited

U.S. PATENT DOCUMENTS

| | | | |
|---|---|---|---|
| 2,065,904 | 12/1936 | Meuer | 200/61.76 X |
| 2,605,374 | 7/1952 | Batcheller | 200/61.76 X |
| 2,606,980 | 8/1952 | Woofter | 200/61.76 |
| 3,119,909 | 1/1964 | Cutler | 200/295 X |
| 3,172,983 | 3/1965 | Zoda | 200/295 |
| 3,213,189 | 10/1965 | Mitchell et al. | 200/295 X |
| 3,249,726 | 5/1966 | Long | 200/295 X |

*Primary Examiner*—J. R. Scott

*Attorney, Agent, or Firm*—Robert F. Meyer

[57] ABSTRACT

The electrical terminals of a plunger switch are held in slots and extend into a housing for the switch substantially along the entire length of the housing. An electrical bridging contact operates between the terminals through movement of a plunger axially movable in the switch. A cap assembly for the housing includes a seal to seal the switch elements from the environment. Spring biased ears extend from the cap of the cup assembly and have notches which engage lugs formed on the housing to secure the cap assembly to the housing. Spring tabs extend from the housing to engage a base member to hold the switch. The spring tabs also trap the ears in their engaged position when the tabs engage the base.

4 Claims, 1 Drawing Sheet

PLUNGER SWITCH

BACKGROUND OF THE INVENTION

The present invention relates to a switch and more particularly to a cap assembly for a plunger type switch.

Plunger switches are commonly used in appliances such as refrigerators. In refrigerators, for example, a plunger switch is used to actuate a function of the refrigerator when its door is opened or closed. In such applications care must be taken to insure that the switch elements are protected from hostile environments. In addition the switch must, of necessity, occupy a minimum of space.

Accordingly it is an object of the present invention to provide a plunger switch which is packaged in such a manner that the effects of the environment on the switch elements are minimized and further that the switch occupies a minimum of space. In addition, the switch is packaged such that it is easily assembled.

SUMMARY OF THE INVENTION

In accordance with the present invention there is provided a plunger switch which in general comprises a housing having an open end and a cap assembly closing the open end, an axially spring biased plunger carried within the housing and extending through the cap assembly, oppositely disposed slots in an end of the housing, electrical terminals extending through the slots and along substantially the length of an interior wall of the housing, a bridging electrical contact extending between the electrical terminals and biased by the plunger to selectively engage and disengage the same, the cap assembly including a cap having ears extending therefrom, notches in the ears which engage lugs on a wall of the housing, and spring tabs extending from the wall of the housing adapted to engage a base member holding the plunger switch and trapping the ears in their engaged position.

DETAILED DESCRIPTION OF THE INVENTION

Figure 1:
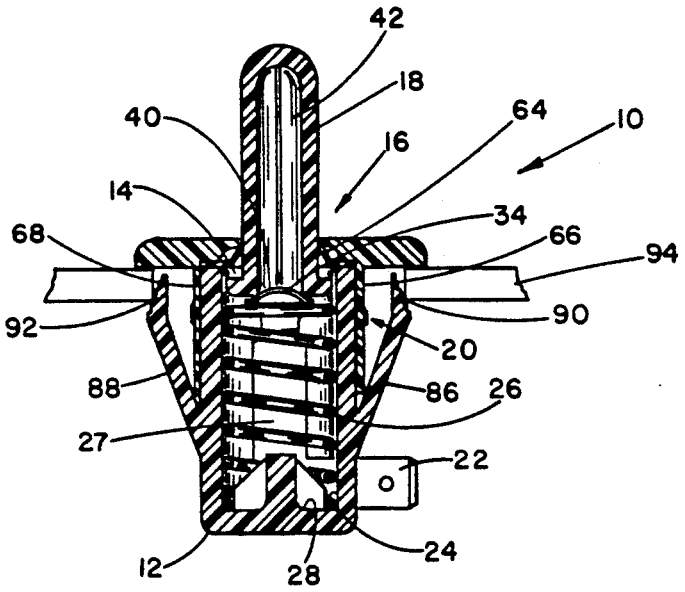
FIG. 1 is a section of the plunger switch.
Figure 2:
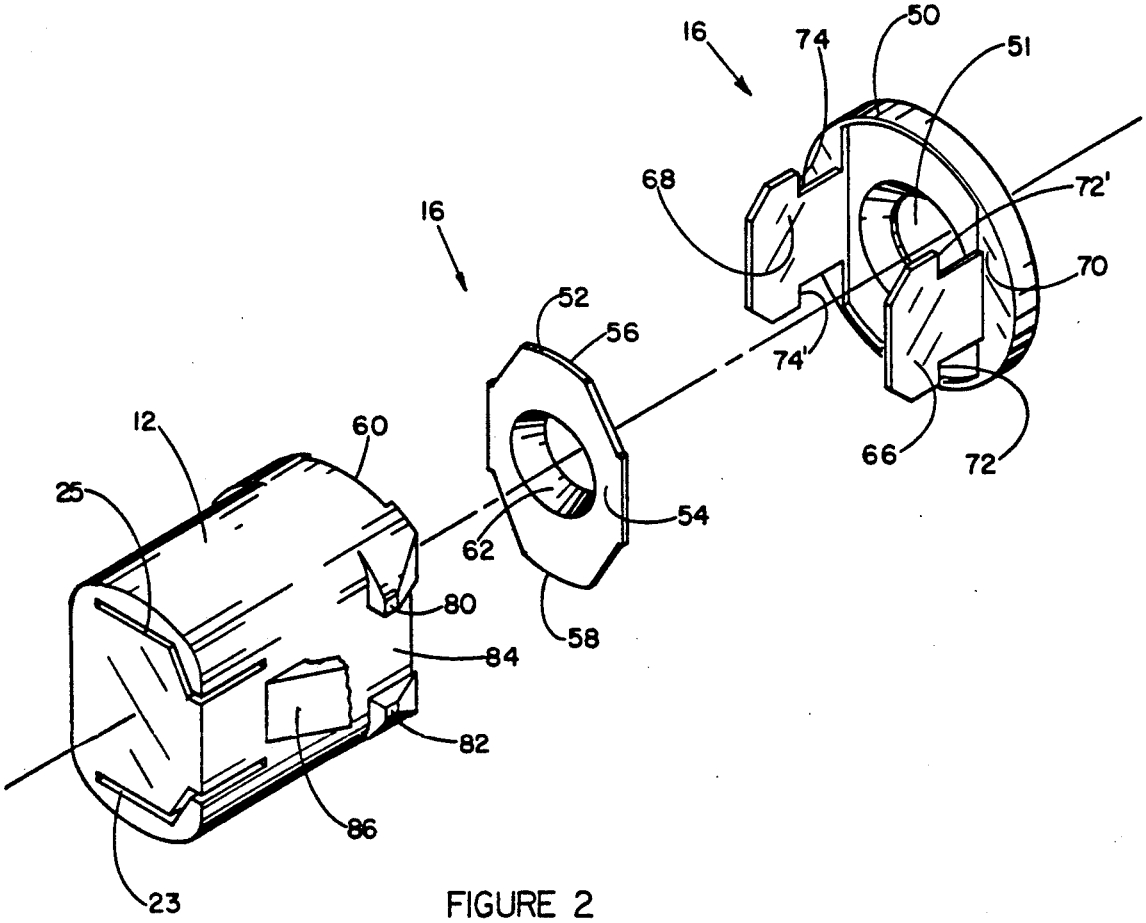
FIG. 2 is an exploded view showing the relationship of the plunger cap assembly to the plunger switch housing.

Referring now to the drawings there is shown a plunger switch 10 which in general includes a housing 12 having an open end 14 that is closed by a cap assembly 16, a hollow plunger 18, an electrical contact assembly 20, and adjacent L-shaped electrical terminals (only one, 22 shown) that are carried in slots 23 and 25. Plunger 18 is spring biased through a coil spring 26 which is held between base 28 of housing 12 and contact assembly 18. Plunger 20 is biased against electrical contact assembly 20.

Electrical contact assembly 20 includes a bar 34 which serves as a bridging electrical contact blade. The ends of the blade individually engage diametrically opposed legs (only one, 27 shown) of the L shaped electrical terminals. The legs are carried lengthwise along a wall 24 of housing 12. The blade is trapped between plunger 18 and coil spring 26. A dimple 40 seats in bore 42 of the plunger to permit the blade to float as it is moved by the plunger axially within housing 12. The floating of the blade aids in maintaining a uniform pressure on the blade as it engages the electrical terminals. Such uniform pressure allows wear between contact surfaces to be evenly distributed. The bridging electrical contact and the electrical terminals are made of a good electrically conductive material such as copper.

In accordance with the invention a cap assembly is provided that effectively closes and seals the open end 14 of the housing. Cap assembly 16 includes a cap 50 and seal 52. Seal 52 includes a disc 54 that fits in the cap and is sealed with housing 12 through flanges 56 and 58. That is, the flanges extend into and over the outside wall 24 of the housing through oppositely disposed notches 60 (only one shown). The flanges are tightly fitted into the notches and the diameter of the plunger 18 is slightly larger than the diameter of aperture 62 so as to deflect seal 52 to form a collar 64 and provide a tight fit with plunger 18. Cap 50 has an aperture 51 through which plunger 18 extends. A suitable material for the seal would be an elastomer such as a thermoplastic rubber.

Cap 50 has ears 66 and 68 extending from its base 70. The ears have notches 72, 72' and 74 and 74' which engage oppositely disposed corresponding pairs (two) of lugs 80 and 82 (only one pair shown) on housing 12. Lugs 80 and 82 are formed on wall 24 of housing 12 and are spaced apart to form a slot 84 to receive the ears. The ears are spring loaded to snap into place.

A pair of oppositely disposed spring clips 86 and 88 aid in mounting the plunger switch to a base. That is, the spring clips have serrations 90 and 92 which engage a base 94. More importantly, as shown in FIG. 1, the spring clip engage ears 66 and 68 and trap them in their engaged position with slot 84 and lugs 80 and 82. Cap 50 is thus securely held in place to tightly hold seal 52 in place.

In operation, the plunger switch is biased to be in the open position when plunger 18 is depressed and closed when the plunger is in a relaxed position. When the plunger is relaxed bridging contact 34 is in engagement with each of the electrical terminals 22 to complete an electrical circuit. When plunger 18 is depressed bridging electrical contact 34 disengages from the electrical terminals.

I claim:

1. A plunger switch comprising:

a housing having an open end and a cap assembly closing said open end, an axially spring biased plunger carried within said housing and extending through said cap assembly, electrical terminals carried within said housing and extending outside thereof, and a bridging electrical contact extending between said plunger to selectively engage and disengage from said electrical terminals, said cap assembly including a cap having a first central aperture therein, a seal carried in said cap and having a second central aperture therein, said plunger forming a tight fit with said seal in said second central aperture, oppositely disposed pairs of lugs extending from a wall of said housing, each lug of said pair of lugs spaced apart to provide a slot there between, oppositely disposed spring loaded ears each extending from a base of said cap, notches in said ears, each of said ears extending through said slot with said notches engaging said lugs, spring clips extending from said wall of said housing engaging a base holding said plunger switch while trapping said spring loaded ears in their engaged position.

2. A plunger switch according to claim 1 wherein said seal includes flanges extending therefrom and engaging notches in said housing.

3. A plunger switch according to claim 2 wherein said second central aperture has a diameter slightly smaller than a diameter of said spring biased plunger such that when said plunger is extended through said second aperture a collar is formed from said seal to form a tight seal with said spring biased plunger.

4. A plunger switch according to claim 1 wherein there are two pairs of lugs, the lugs of each pair spaced apart to provide a slot receiving one of said ears.

* * * * *